US005568673A

United States Patent [19]

Ryczek

[11] Patent Number: 5,568,673

[45] Date of Patent: Oct. 29, 1996

[54] PIVOT PIN ASSEMBLY FOR FOLDING DOOR

[75] Inventor: William F. Ryczek, Covina, Calif.

[73] Assignee: Arthur Cox & Sons, Inc., City of Industry, Calif.

[21] Appl. No.: 330,334

[22] Filed: Oct. 27, 1994

[51] Int. Cl.[6] ..... E05D 7/04

[52] U.S. Cl. ..... 16/244; 16/248

[58] Field of Search ..... 16/378, 379, 242, 16/243, 244, 245, 246, 248; 49/388; 160/206

[56] References Cited

U.S. PATENT DOCUMENTS

| | | | |
|---|---|---|---|
| 1,563,869 | 12/1925 | Larson | 16/243 |
| 2,915,118 | 12/1959 | Capitani . | |
| 3,170,506 | 2/1965 | Johnson . | |
| 3,302,691 | 2/1967 | Andrews et al. . | |
| 3,390,418 | 7/1968 | Sheridan . | |
| 3,597,790 | 8/1971 | Kellem | 16/244 |
| 4,095,310 | 6/1978 | Governale . | |
| 4,729,615 | 3/1988 | Ishizawa et al. . | |

FOREIGN PATENT DOCUMENTS

| | | | |
|---|---|---|---|
| 474190 | 2/1915 | France | 16/243 |
| 60050 | 12/1925 | Sweden | 16/243 |

*Primary Examiner*—M. Rachuba
*Assistant Examiner*—Donald M. Gurley
*Attorney, Agent, or Firm*—Knobbe, Martens, Olson & Bear

[57] ABSTRACT

A means for the vertical or height adjustment of folding doors comprises a pivot pin assembly utilizing a threaded adjustment bolt with a separate, unthreaded pivot pin. The bolt is threaded into the sleeve above the pivot pin. A lower interior portion of the sleeve includes a polygonal interior cross-section which matches the head of the pin and prevents the pin from rotating. The pivot pin may be held within the sleeve during shipment and installation by a friction fit with a cap positioned in the bottom of the sleeve, or instead a spring may be used between the pivot pin and cap to urge the pin upwardly. Rotation of the bolt vertically adjusts the pin.

19 Claims, 4 Drawing Sheets

Fig. 4
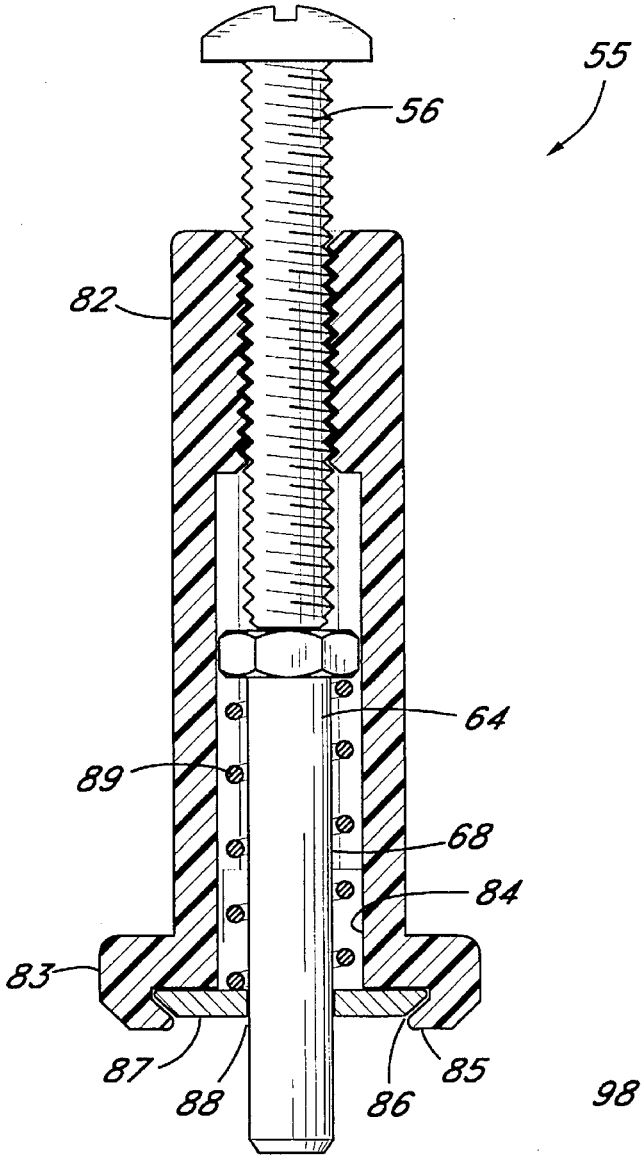
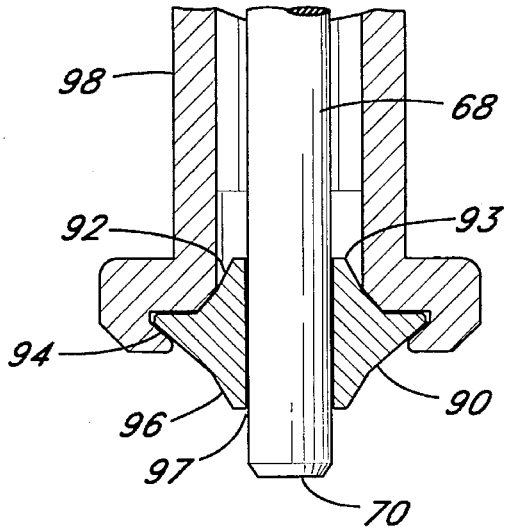
Fig. 3

104
102
100
108
112
106
110
114
99
116
120
118
124
130
122
133
132
134
136
138
140
142

99
108
107
109
100
112
110
106
114
116
133
120
118
132
124
138
122
142
126
144
128
146
136

PIVOT PIN ASSEMBLY FOR FOLDING DOOR

BACKGROUND OF THE INVENTION

The present invention relates to a means for height adjustment of folding doors, and in particular to a pivot pin assembly for use therefor. Pivot pin assemblies are located on the inside of the folding door and provide the vertical alignment necessary for proper operation during opening and closing of the folding door.

Folding doors have long been used in situations where limited "swing" area for a door is available or desired for closets and the like. Folding doors include at least one pair of guide and pivot doors. The front of the folding door may be prefinished or improved and may include a knobbed or flanged handle.

The framework of the folding door, including the rails stiles, hinges, and corner blocks, are typically exposed at the back of the guide and pivot doors. The rails are horizontal members to which are attached the corner blocks containing the guide and pivot assemblies. Additional corner blocks are located where the hinges connect the guide and pivot doors. The stiles are vertical members to which is attached the handle. Stiffening members may be provided on the pivot door for added structural integrity.

Today, folding doors are typically assembled within a factory and often installed by an installer or by the homeowner. During installation, the folding doors are to be aligned to be plumb with the door frame of the closet. If two pairs of guide and pivot doors are used, they must be installed such that they are horizontally and vertically aligned with one another as well.

For horizontal alignment with the upper door frame, the top and/or bottom track bracket is adjusted. The vertical alignment of the folding door is usually accomplished by adjusting only the bottom pivot pin. The pin may either be contained in a housing or directly inserted within one of the cavities of the bottom, inside corner block. The adjustment is typically done with a thin wrench to be inserted beneath the lower edge of the door, and is an awkward procedure because of the corner block's position inside the closet. An adjustment or lock nut is sometimes used to maintain the height of the door after installation and alignment. The difficulty in using a wrench for the height adjustment is compounded by the fact that it involves a certain amount of trial and error.

Another way of vertically adjusting the doors is by the use of a lock nut with a threaded pivot pin having a slotted head. Thus, a screwdriver may be used to adjust the pivot pins instead of a wrench. However, whether the pivot pin is adjusted by a screwdriver or a wrench, a "ratchet" effect occurs over time, as the pivot pin is "torqued" by the swinging open and close of the door. The pin is rotated at a point of contact of its bottom end with the track bracket. The lock nut is rotated by the pivoting of the pin and becomes loosened. The ratchet effect occurs from the weight of the door that is supported by the pivot pin, which causes the pin to only adjust downward. Thus, misalignment of the door results as the pin is rotated and no longer held in the proper position by the lock nut.

In view of the foregoing, a need exists for an improved pivot pin adjustment mechanism that overcomes the problems mentioned.

SUMMARY OF THE INVENTION

A pivot pin assembly of the present invention comprises an outer sleeve, a threaded adjustment bolt, and a pivot pin.

The sleeve is threaded on an upper interior portion for engagement of the bolt, and has a lower interior portion having a non-circular shape substantially the same as the top of the pin. The threaded end of the bolt abuts the top of the pin, which is contained within the sleeve. The dual pin construction of the present invention prevents rotation of the lower pin.

Unlike the previous pivot pin assemblies, the present invention utilizes a threaded component coaxially aligned above an unthreaded component, such that any torquing or rotation resulting from repeated opening and closing of the folding door is not transmitted between the components. That is, the lower pivot pin is limited to axial or longitudinal motion within the sleeve, guided by the fit of its top end within the interior of the lower portion of the sleeve, and does not act to rotate the adjustment bolt. The bolt head is formed to mate with a tool for rotating the bolt.

Additional means for retaining the pin within the sleeve during shipment and installation may be included in the assembly. A bushing or washer-type "end cap" having an aperture centrally located may be used. The bottom of the pin's shaft thus protrudes through the aperture, while the head of the pin is maintained within the sleeve. The cap may have a tight, friction fit with the pin shaft, or it could be combined with a spring that surrounds the pin shaft inside the sleeve. In a preferred embodiment, the bolt, the pin, and the cap aperture are coaxially aligned within the sleeve, and the pin shaft is press-fitted into the aperture.

The head of the pin is preferably hexagonal, although the configuration of the threaded and hexagonal portions of the sleeve interior, as well as the pin's head, may vary in alternate embodiments of the present invention. The hexagonal design of the sleeve interior and corresponding shape of the pivot pin's head may be substituted with any shape, such as oval or "key"-shaped, which serves to prevent rotation of the pin within the sleeve.

Since only a portion of the sleeve interior and only the adjustment bolt (not the pivot pin) require threading, the manufacturing cost is reduced. And, the end cap construction is no more costly than the use of lock nuts. Also, since the vertical alignment of the folding door is accomplished by adjustment of the bottom pivot, the pivot pin assembly of the present invention may be used at this bottom location and any of an existing supply of "old" pivot pins may be used at the top position of the pivot door, further reducing costs. Thus, the advantages of the pivot pin assembly of the present invention include a reduction in cost, simpler installation, and improved operation of the folding doors.

Further advantages and applications will become apparent to those skilled in the art from the following detailed description and the drawings referenced herein.

BRIEF DESCRIPTION OF THE DRAWINGS

FIG. 3 is another embodiment of a friction-fitted end cap used in the pivot pin assembly of the present invention.

FIG. 4 illustrates a second embodiment of the pivot pin assembly of the present invention, wherein a spring is used with the bolt and pin of the embodiment of FIG. 2, and a sleeve, a cap, and the spring are shown in cross-section.

DETAILED DESCRIPTION OF THE DRAWINGS

Overview of a Folding Door

Figure 1:
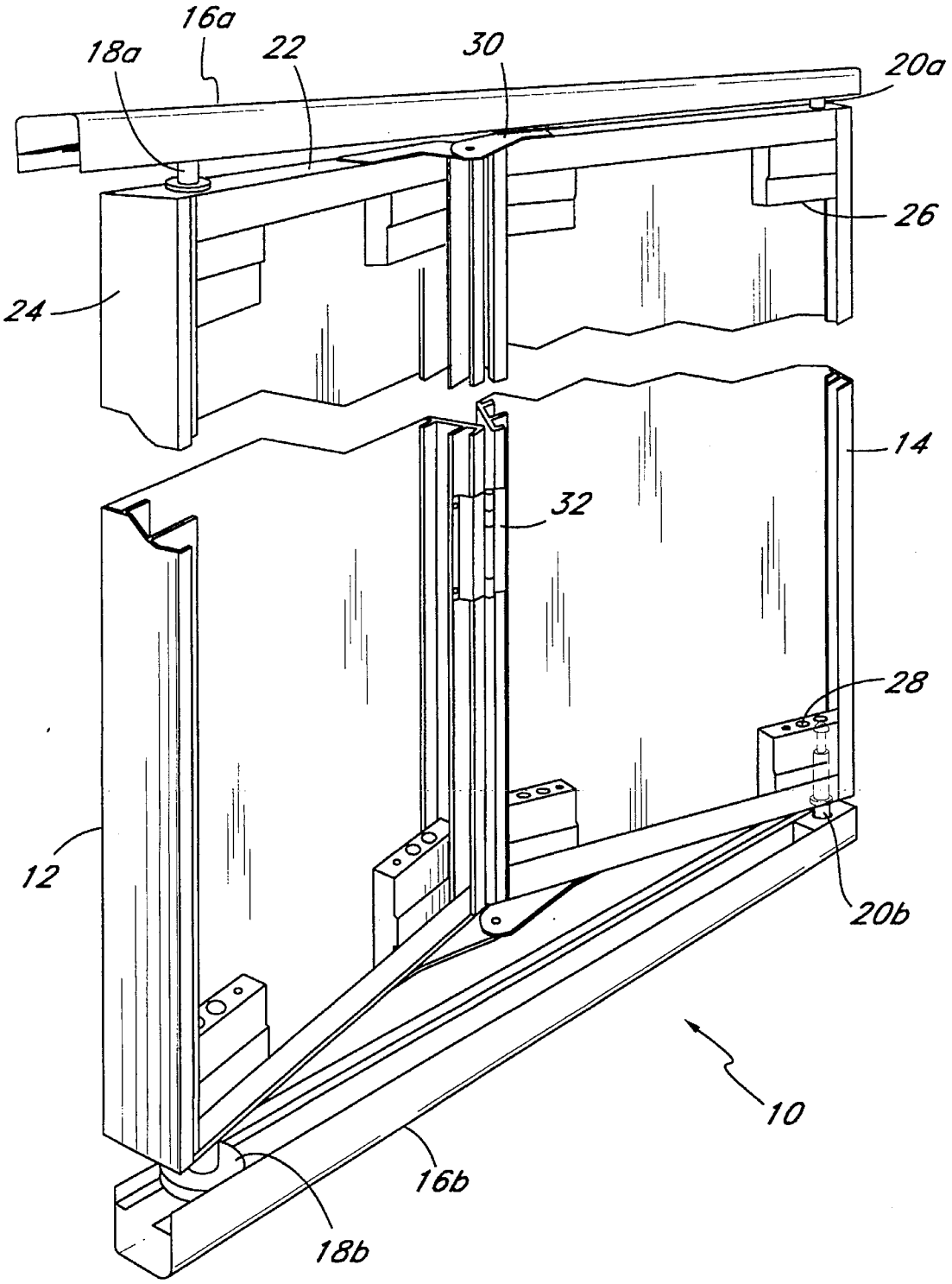
FIG. 1 is a perspective view of the inside of a typical folding door, illustrating a guide and pivot door pair and framework components that include a bottom corner block containing a pivot pin assembly (shown in phantom).

Refer now to FIG. 1 which illustrates the standard construction of a folding door, generally referenced by the numeral 10, such as used for closets. FIG. 1 shows the back or inside view of the framework of the door 10, including a guide door 12 and a pivot door 14. Folding doors 10 may have mirrored or pre-finished panels (not shown) on the front or outside. These doors 12, 14 are used with tracks 16*a,b* which are mounted onto the top and bottom of a door frame using brackets (not shown). While only one pair of guide and pivot doors 12, 14 is shown, it is well known to use more than one such pair. The following description will be limited to a folding door comprised of one guide and pivot door pair.

As illustrated in FIG. 1, the components which actually contact the top and bottom tracks 16*a,b* are upper and lower guide assemblies 18*a,b* and pivot pin assemblies 20*a,b*. The guide assemblies 18*a,b* are mounted in the corners of an entry side of the guide door 12, through which the closet may be accessed. The guide assemblies 18*a,b* include guide wheels for rolling along the tracks 16*a,b*. The pivot pin assemblies 20*a,b* are mounted in corner blocks 26 in the inside corners of the pivot door 14. Likewise, the assemblies 18, 20 are mounted in corner blocks 26 on the outside corners, one pin being shown in phantom for the bottom pivot pin assembly 20*b*.

The folding door 10, as shown in FIG. 1, is additionally comprised of rails 22 which are located laterally across the tops and bottoms of the guide and pivot doors 12, 14. Vertically positioned stiles 24 complete the rectangular peripheral construction of the doors 12, 14. The corner blocks 26 add strength and rigidity at the perpendicular junctures of the rails 22 and stiles 24. The blocks 26 are typically formed of plastic, although they may be wood or metal as well, and are mounted to the insides of the rails 22 during pre-installation assembly of the door 10.

Not shown in the drawings, the guide and pivot pin assemblies 18, 20 are mounted to the doors 12, 14 via holes provided near the end of each rail 22. The assemblies 18, 20 are "tapped" in place by the installer from the outer side of the rails 22, through the holes, and into cylindrical cavities 28 formed in the blocks 26, prior to installation of the door 10. In wooden doors not requiring corner blocks 26, the assemblies 18, 20 are tapped directly into holes at the corners of the door frame.

Referring once more to FIG. 1, hinge members 30 are attached to the rails 22 where the guide and pivot doors 12, 14 adjoin. The adjacent stiles 24 of the guide and pivot doors 12, 14 typically include at least one additional hinge 32. A handle (not shown) may be formed on or attached to the outer stile 24, or a handle may be located near the hinged stiles 24 of the doors 12, 14.

Thus, the pre-installation assembly of the door 10 includes the steps of mounting the tracks 16 to the door frame, attaching the rails 22, stiles 24, corner blocks 26, and hinges 30, 32 together with the mirrored or pre-finished panels, and mounting the guide and pivot assemblies 18, 20 to the doors 12, 14. The installation of the door 10 includes positioning the guide wheels onto the tracks 16, horizontally aligning the door 10 by adjusting the track brackets, and vertically aligning the door 10 by adjusting the bottom pivot pin assembly 20*b*.

Pivot Pin Assembly

Figure 2:
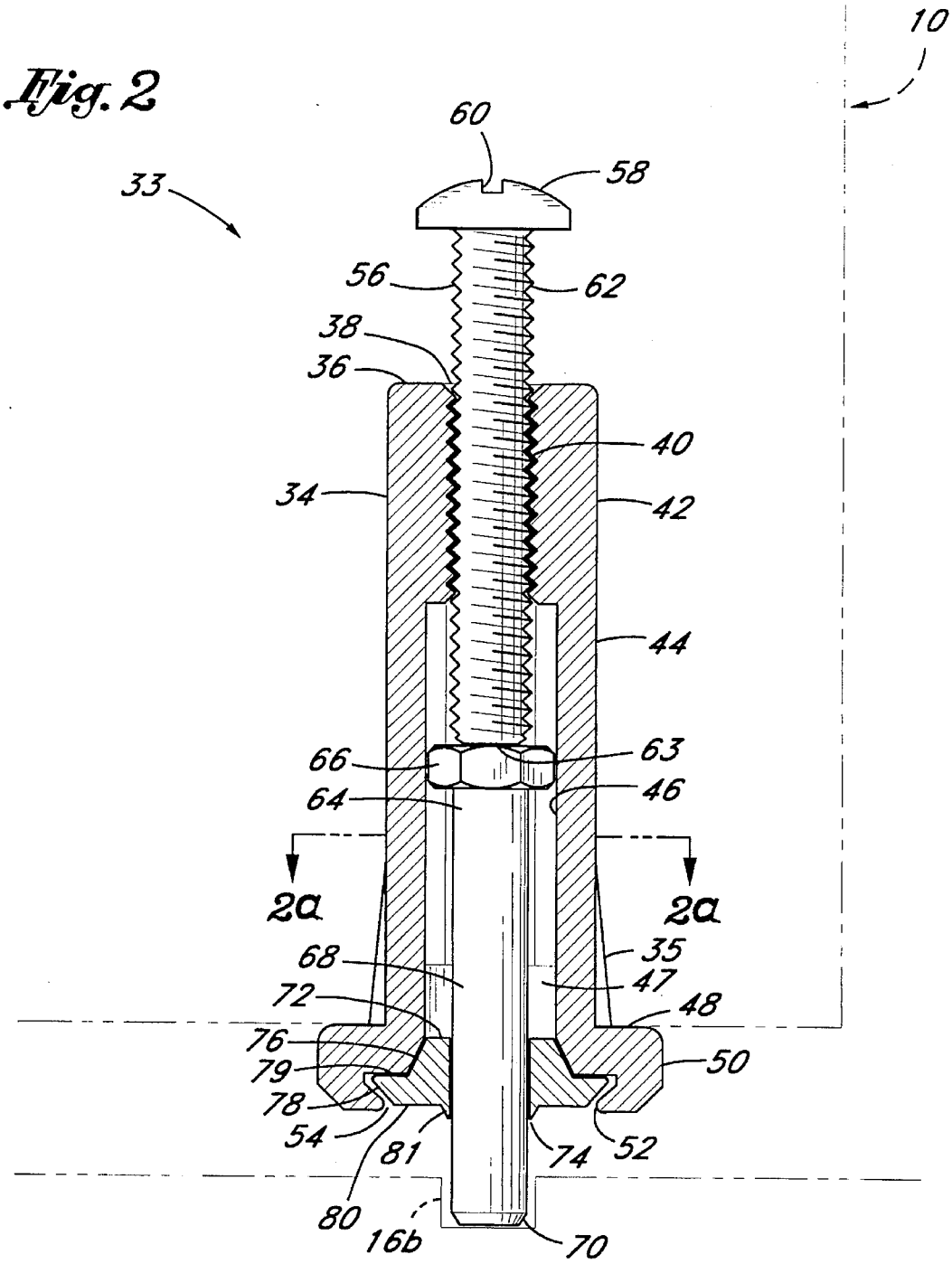
FIG. 2 illustrates a preferred embodiment of the pivot pin assembly of the present invention showing a sleeve, adjustment bolt, pivot pin, and cap of the assembly, wherein the sleeve and cap are shown in cross-section and the pivot door and bottom track are shown in phantom.

Referring now in detail to FIG. 2, a preferred embodiment of a pivot pin assembly 33 is shown after installation, where the bottom inside corner of the door 10 and the bottom track 16*b* are shown in phantom. For clarity, the corner block 26 in which the assembly 33 is mounted is not shown.

The assembly 33 of FIG. 2 includes a housing or sleeve 34 which has ribs or fins 35 which provide an interference fit into the cylindrical cavity 28 in a corner block 26. In one embodiment, the sleeve 34 is manufactured from acetal, and the length of the sleeve 34 is approximately 2.15".

Figure 2A:
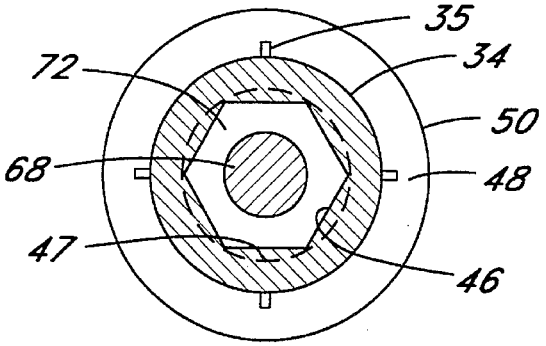
FIG. 2*a* is a cross-sectional view, taken along line 2*a*–2*a* of FIG. 2 to show the hexagonal lower interior of the cylindrical sleeve.

The interior of the sleeve 34 has been designed to contain differing cross-sectional shapes at its top, middle, and bottom portions. Specifically, a top portion 42 has a threaded interior section 40, with the threaded portion extending about one-third of the sleeve length. A middle portion 44 of the sleeve 34 has an interior, polygonal cross-section 46, preferably hexagonal, extending nearly half the length of the sleeve 34. The hexagonal cross-section 46 is seen more clearly in FIG. 2*a*, and in alternate embodiments may be another non-circular shape.

A cylindrical interior section 47 is located near the bottom of the sleeve 34, below the hexagonal section 46. The cylindrical section 47 is approximately one-sixth the overall length of the sleeve 34. However, it will be demonstrated by the embodiment of FIGS. 5 and 6 that the bottom, cylindrical section 47 is not a necessary feature of the present invention.

Referring once more to FIG. 2, a shoulder 48 forms an annular stop portion near the bottom of the sleeve 34, and provides partial support of the door 10. A bottom portion 50 commencing from the shoulder 48 comprises approximately one-eighth the length of the sleeve 34, and has an inner rim or "lip" 52 and an opening 54 at the bottom end.

A bolt 56 has a head 58 with a slot 60 formed to receive a screwdriver or other tool for rotating the bolt 56 to adjust the pivot pin assembly 33. A threaded shaft 62 of the bolt 56 has a diameter for close engagement with the threaded section 40 of the sleeve 34. As shown in FIG. 2, this diameter is the smallest inner diameter of the sleeve 34. The length of the shaft 62 is sized to ensure that the head 58 of the bolt 56 is in contact with an upper face 36 of the sleeve 34 when a bottom end 63 of the bolt 56 reaches the lower boundary of the hexagonal section 46 of the sleeve 34.

The purpose of specifying the length of the bolt shaft 62 is to ensure that a pivot pin 64 of the assembly 33 has its hexagonally-shaped head 66 engaged in the hexagonal section 46 of the sleeve 34 up to the point when the bolt 56 "bottoms out". That is, when the bolt head 58 contacts the sleeve upper face 36, the installer or adjuster knows that the pin head 66 is no longer constrained by the hexagonal section 46 to axial or longitudinal motion within the sleeve 34.

In a working version of the embodiment of FIG. 2 having an overall sleeve length of 2.15", the threaded section 40 is 0.65" long and the hexagonal section 46 is 0.875" long. Thus, the bolt shaft 62 is preferably 1.525" long. The cylindrical section 47 of the sleeve 34 is 0.375" long, and the bottom portion 50 is 0.25" long.

There is a further length requirement on the pin 64 of the assembly 33 of FIG. 2 in that, if the pin head 66 is 0.125" long, then a shaft 68 of the pin 64 must be at least 1.25" long. The total length of 1.375" ensures that a bottom end 70 of the pin 64, which is preferably blunt, is maintained in the bottom portion 50 of the sleeve 34, even when the pin head 66 is pushed as far as possible into the hexagonal section 46 of the sleeve 34.

As illustrated in FIG. 2, the pin 64 is preferably maintained within the sleeve 34 by a retaining element or end cap 72 which is captured in the opening 54 of the sleeve 34 by the lip 52. The pin shaft 68 protrudes through an aperture 74 in the cap 72. The aperture 74 of the end cap 72 is of substantially the same diameter as the shaft 68 to provide a tight, friction fit with the shaft 68 and maintain the pin's head 66 in the hexagonal section 46 during shipping. The friction fit also keeps the pin 64 from protruding too far and obstructing the placement of the door 10 onto the track **16*b*** during the door installation.

The end cap 72 of the embodiment of FIG. 2 is preferably formed of a tough plastic, such as polycarbonate, although it may also be of die cast metal construction. The cap 72 is comprised of a top portion 76 of circular outer diameter with an increasing radius or taper to a middle portion 78. The tapered shape corresponds to the interior at this part of the bottom portion 50 of the sleeve 34. A shoulder 79 is formed at the middle portion 78 of the cap 72. The shoulder 79 has an outer diameter greater than the opening 54 of the sleeve 34, which keeps the cap 72 in place after it has been pressed into the bottom 50 of the sleeve 34.

As illustrated in FIG. 2, the shoulder 79 and top portion 76 of the cap 72 engage the interior of the bottom portion 50 of the sleeve 34. The shape of the middle portion 78 of the cap 72 generally matches the inner contour of the lip 52 of the sleeve 34. In this embodiment, a bottom 80 of the cap 72 includes a neck 81 around the aperture 74; however, it will be seen that this neck 81 and other portions of the cap 72 may be modified or eliminated as in the alternate embodiments of FIGS. 3–6.

FIG. 3 illustrates another embodiment of a friction-fitted end cap 90. The cap 90 has a top 92, middle 94, and bottom 96 portion which are generally similar to the cap 72 of the assembly 33. A sleeve 98 also has the same general construction as the sleeve 34 of the assembly 33. The end cap's top portion 92 is extended further upward such that a top face 93 has an outer diameter smaller than the inner diameter of that part of the sleeve 98. This extra cap length further ensures the containment of the bottom end 70 of the pivot pin 64 in an aperture 97 of the cap 90.

As shown in FIG. 3, the middle portion 94 is integrated with the bottom portion 96, the combination of which is larger than for the previous cap 72. The overall length of the cap 90 is more than twice the length of the cap 72 of the assembly 33, therefore providing more than twice the aperture area for frictional contact of the shaft 68. As a result, the aperture 97 of the cap 90 is not necessarily toleranced as closely to the diameter of the shaft 68. Although, the extended length of the bottom portion 96 also results in a minimum height adjustment of the door 10 due to the protrusion of the bottom portion 96 from the end of the sleeve 98.

Referring now in detail to FIG. 4, another embodiment of a pivot pin assembly 55 of the present invention includes the bolt 56 and pin 64 of the assembly 33 of FIG. 2. A sleeve 82 corresponds to the sleeve 34 of the previous assembly 33 except at its bottom portion 83. A bottom, cylindrical interior section 84 does not include a tapered portion at its end, but instead forms a right angle to the end of the sleeve 82, which includes a lip 85 around an opening 86.

An end cap 87 of the assembly 55 of FIG. 4 is pressed into place through the opening 86. This cap 87 does not include a top and bottom portion like those of the previous caps 72, 90 but instead has a flattened disk shape with a beveled outer diameter to correspond to the inside of the lip 85.

In this embodiment, an aperture 88 of the end cap 87 may be larger than the previous apertures 74, 97 although the pin 64 is the same. As illustrated in FIG. 4, this is because a spring 89 is used to maintain the pin 64 within the cylindrical interior section 84 during shipment and installation of the assembly 55, instead of the tight, press-fit of the cap 72 of the assembly 33 or the friction fit of the longer cap 90.

The spring 89 also provides an opposing force to the weight of the door 10, and slightly counters the load on the threads of the adjustment bolt 56. The spring 89 preferably has an inner diameter at least as large as the diameter of the shaft 68 of the pin 64, and an outer diameter smaller than the inner diameter of the middle of the sleeve 82. Preferably, the length of the spring is at least the length of the cylindrical section 84 of the sleeve 82.

Figure 5:
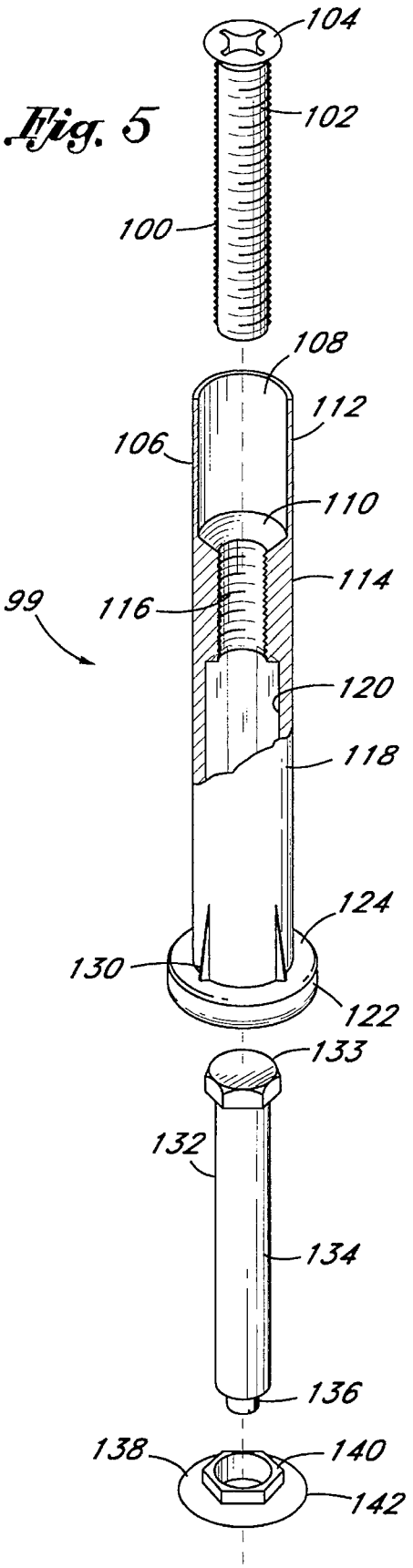
FIG. 5 is an exploded perspective view of a third embodiment of the pivot pin assembly of the present invention, with a sleeve partially cut away to show the threaded interior.
Figure 6:
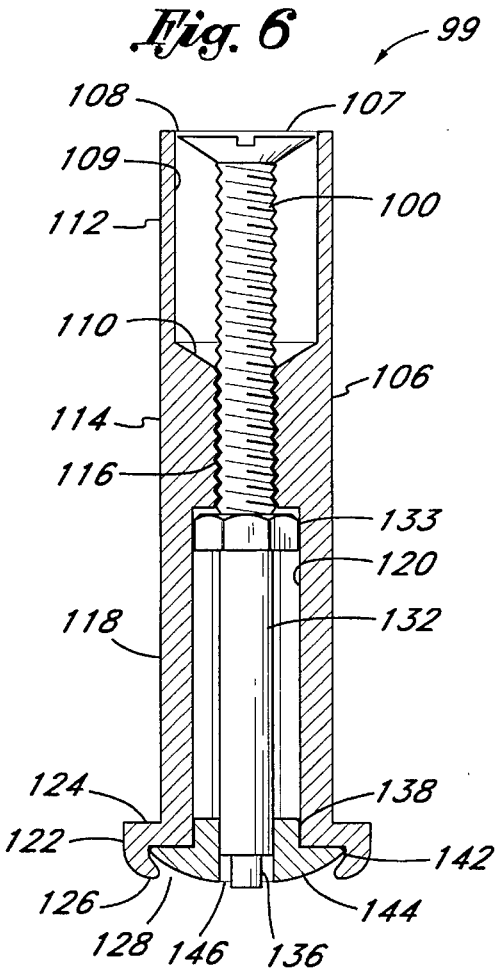
FIG. 6 is an assembled view of the embodiment of FIG. 5, with the sleeve and cap shown in cross-section.

A third embodiment of the pivot pin assembly of the present invention is illustrated in FIGS. 5 and 6. Here, a pivot pin assembly 99 is comprised of a sleeve 106, an adjustment bolt 100, a pivot pin 132, and an end cap 138. The assembly 99 is designed for use of a Phillips screwdriver to rotate the bolt 100, since it permits access to the bolt 100 as it travels into the sleeve 106.

A shaft 102 of the bolt 100 is inserted through an opening 108 of the sleeve 106 into a cylindrical interior section 109, until its head 104 is positioned below a plane 107 formed by the top end of the sleeve 106. The head 104 when fully inserted eventually contacts a beveled or slanted interior section 110 of a top portion 112 of the sleeve 106, as seen more clearly in FIG. 6. A middle portion 114 of the sleeve 106 includes a threaded interior section 116 for engagement with the threaded shaft 102 of the bolt 100.

A bottom portion 118 of the sleeve 106 includes an interior of hexagonal cross-section 120 which extends to a bottom end 122 and prevents the pin 132 from rotating in the sleeve 106 at all times. On its outer circumference, the sleeve 106 includes a shoulder 124 delineating the bottom end 122. Referring to FIG. 5, triangular, fin-like projections 130 are joined to the outer circumference of the bottom portion 118 and the shoulder 124. These projections 130 provide a tighter fit of the assembly 99 in the corner blocks 26. Returning in detail to FIG. 6, a lip 126 and opening 128 in the bottom end 122 of the sleeve 106 are generally similar to the previous sleeve configurations 34, 82.

The assembly 99 of FIGS. 5 and 6 allows a shorter-shafted bolt to be used to attain the same height adjustment as the previous assemblies 33, 55. For the preferred length of the bolt 100, the bolt 100 can only contact the pin 132 contained in the sleeve 106 after passing below the plane 107.

The pin 132 of the assembly 99 of FIGS. 5 and 6 preferably has a length enabling a shaft 134 of the pin 132 to be maintained in the end cap 138 even when a head 133 of the pin 132 is pushed as far as possible into the sleeve 106. Although, preferably the length of the pin 132 is insufficient for an end 136 to protrude when the head 133 is pushed all the way into the sleeve 106. Unlike the previous assemblies 33, 55, the end 136 of the pin 132 has a smaller outer diameter than the remaining, majority of the pin shaft 134. This provides a smaller area of contact with the bottom track **16*b*, and thus less rotational force on the pin 132**.

In order to accommodate the extension of the hexagonal section 120 to the bottom of the sleeve 106, the end cap 138 has a similarly dimensioned, hexagonally-shaped top portion 140. The top portion 140 adjoins a middle portion 142 of the cap at a right angle, and the end cap 138 has a rounded outer contour on its bottom portion 144. An aperture 146 of the end cap 138 is preferably sized to maintain a friction fit with the shaft 134 of the pin 132.

Pre-Assembly, Installation, and Vertical Adjustment

Prior to shipment by the manufacturer of the pivot pin assembly 33 of FIG. 2, the unthreaded pivot pin 64 may be inserted into the opening 54 at the bottom end of the sleeve 34 (head first), and the cap 72 pressed into place. The adjustment bolt 56 may be partly screwed into the top opening 38 of the sleeve 34, and thus the pivot pin assembly 33 may be provided pre-assembled by the manufacturer. Alternately, the end cap 72 may be omitted, and only the sleeve 34, bolt 56, and pin 64 provided to the customer, with the pin 64 loose from the sleeve 34.

Additionally, for the pivot pin assembly 55 of FIG. 4, the spring 89 may be placed over the pin shaft 68 prior to fastening the cap 87 onto the end of the sleeve 82. Again, the assembly 55 is provided to the customer pre-assembled by the manufacturer.

Referring to FIGS. 1 and 2, the installer taps the pivot pin assembly 33 into the pivot door 14, into one of the cavities 28 of the corner block 26 from outside the rail 22.

After installation of the door 10, the corner block 26 containing the pivot pin assembly 33, with the pivot pin 64, is located on the inside, bottom of the closet. The bottom 70 of the pin 64 is positioned in the bottom track bracket **16*b*. The bolt 56 is then exposed through the corner block 26, and a screwdriver is preferably used to rotate the bolt 56. The bottom of the bolt 63 contacts the head 66 of the pin 64 which is coaxially positioned below it. As the bolt 56 is rotated further into the sleeve 34, the pin 64 is forced out of the sleeve 34, thereby adjusting the height of the door 10**.

Thus, the folding door height or vertical adjustment provided by a pivot pin assembly of the present invention has the following advantages: 1) A self-contained pivot pin assembly that eliminates the need for a separate element to prevent the torquing of the pivot pin which results in vertical misalignment; 2) A pivot pin assembly which eliminates the need for a wrench for the vertical adjustment and thereby reduces the awkwardness of the inside location of the pivot pin assembly on the folding door; and, 3) Pivot pin assembly components which are lower in cost to manufacture.

The embodiments of FIGS. 1–6 are merely illustrative of the components which may be utilized in the pivot pin assembly of the present invention. Other changes and modifications may be made from the embodiments presented herein by those skilled in the art without departure from the spirit and scope of the invention, as defined by the appended claims.

What is claimed is:

1. A pivot pin assembly for a folding door comprising:

a sleeve to be mounted in the lower end of the folding door, said sleeve including an upper portion having a threaded interior and a lower portion having an interior section of non-circular shaped cross-section;

a bolt having a threaded shaft which threads into said upper portion;

a pin in said lower portion, the pin being aligned below the bolt and having a head which engages said non-circular shaped section of the sleeve in a manner to prevent relative rotation of the pin in the sleeve while permitting longitudinal motion of the pin head along substantially the entire length of said non-circular shaped section, the pin having a lower end which protrudes below the sleeve and the lower end of the folding door.

2. A pivot pin assembly for a folding door comprising:

a sleeve including an upper portion having a threaded interior and a lower portion having an interior section of non-circular shaped cross-section;

a bolt having a threaded shaft which threads into said upper portion;

a pin in said lower portion, the pin aligned below the bolt, having a head which engages said non-circular shaped section of the sleeve in a manner to prevent relative rotation of the pin in the sleeve while permitting longitudinal motion along the length of said non-circular shaped section, the pin having a lower end which protrudes below the sleeve; and a retaining element on the lower portion of the sleeve for maintaining at least said pin head inside the sleeve.

3. The pivot pin assembly of claim 2, wherein an aperture of the retaining element provides a frictional fit with the pin shaft.

4. The pivot pin assembly of claim 2, wherein said assembly further includes a spring surrounding the pin shaft.

5. The pivot pin assembly of claim 2, wherein the sleeve further includes a bottom which has a lip that captures the retaining element in the sleeve.

6. The pivot pin assembly of claim 2, wherein the head of the bolt is formed to mate with a tool for rotating the bolt.

7. A pivot pin assembly for a folding door comprising:

a sleeve including an upper portion having a threaded interior, a lower portion having an interior section of polygonally-shaped cross-section and a bottom;

a bolt having a threaded shaft which threads into said upper portion;

a pin in said lower portion, the pin aligned below the bolt, having a head on its upper end which engages said polygonally-shaped section of the sleeve in a manner to prevent relative rotation of the pin in the sleeve while permitting longitudinal motion along the length of said polygonally-shaped section; and a retaining element attached to the bottom of the sleeve, the pin having a lower end which protrudes through an aperture in the element.

8. The pivot pin assembly of claim 7, wherein said assembly further includes a spring surrounding the pin shaft.

9. The pivot pin assembly of claim 7, wherein the head of the bolt is formed to receive a tool for rotating the bolt.

10. The pivot pin assembly of claim 7, wherein the bottom end of the sleeve has an inner lip for capturing the retaining element.

11. The pivot pin assembly of claim 7, wherein said upper portion of the sleeve further includes a top section having a cylindrical interior large enough to receive the head of the bolt.

12. The pivot pin assembly of claim 7, wherein said lower portion of the sleeve further includes a bottom section having a cylindrical interior at least the diameter of said pin head.

13. The pivot pin assembly of claim 7, wherein the length of the pin is substantially the length of said lower portion of the sleeve.

14. The pivot pin assembly of claim 7, wherein the length of the bolt is at least the length of said upper portion of the sleeve.

15. A pivot pin assembly for a folding door comprising:

a sleeve having a threaded upper interior portion, a hexagonally-shaped lower interior portion and a bottom;

a bolt having a threaded shaft which threads into said upper portion;

a pin having a head substantially the same diameter and hexagonal shape as said lower portion, the length of the pin substantially the same as the length of said lower portion; and an end cap attached to an inner lip on the bottom of the sleeve, the cap having an aperture substantially the same diameter as a shaft of the pin, wherein the bolt is threadably inserted through the top of the sleeve and abuts said pin head, at least the bottom end of the pin extending into said aperture of the cap, such that the pin is limited to motion along the longitudinal axis of said lower portion of the sleeve.

16. The pivot pin assembly of claim 15, wherein said assembly further includes a spring surrounding the pin shaft.

17. The pivot pin assembly of claim 15, wherein the head of the bolt is formed to receive a tool for rotating the bolt.

18. A method of constructing a pivot pin assembly comprising the steps of:

threading a shaft of a bolt into a top end of a sleeve;

inserting a pin into an interior of the sleeve having a non-circular cross-section, the pin having a bottom which extends through an aperture of an end cap and a head substantially conforming to the sleeve interior in a manner to prevent the pin from rotating within the sleeve; and fastening the cap onto a bottom end of the sleeve such that the pin is maintained within the sleeve and limited to motion along the longitudinal axis of the sleeve.

19. A method of adjusting the height of a folding door comprising the steps of:

vertically positioning a sleeve at the corner of the door, the sleeve including a lower portion having an interior of non-circular cross-section and containing a pin having a head which fits within such cross-section in a manner to prevent rotation of the pin;

installing the door onto a track;

threading a bolt into a threaded upper portion of the sleeve; and rotating the bolt to move the pin vertically until a bottom of the pin extends out of the lower portion of the sleeve to contact the track and the desired height of the door is achieved.

* * * * *